US012575671B2

(12) United States Patent
Wu et al.

(10) Patent No.: US 12,575,671 B2
(45) Date of Patent: Mar. 17, 2026

(54) WEIGHT TRAINING EQUIPMENT STORAGE RACK SYSTEM

(71) Applicant: VONRANG INTERNATIONAL CORPORATION, Taipei (TW)

(72) Inventors: Chun-Yi Wu, Taipei (TW); Wayne Tsu-Wei Liu, Taipei (TW); Jue-An Liu, Taipei (TW)

(73) Assignee: VONRANG INTERNATIONAL CORPORATION, Taipei City (TW)

( * ) Notice: Subject to any disclaimer, the term of this patent is extended or adjusted under 35 U.S.C. 154(b) by 0 days.

(21) Appl. No.: 18/826,872

(22) Filed: Sep. 6, 2024

(65) Prior Publication Data

US 2025/0318639 A1 Oct. 16, 2025

(51) Int. Cl.
*A47B 57/20* (2006.01)
*A47B 81/00* (2006.01)
*A63B 21/072* (2006.01)

(52) U.S. Cl.
CPC ..... *A47B 57/20* (2013.01); *A47B 81/00* (2013.01); *A63B 21/072* (2013.01)

(58) Field of Classification Search
CPC ..... A47B 57/20; A47B 81/00; A63B 21/072
See application file for complete search history.

(56) References Cited

U.S. PATENT DOCUMENTS 625,271 A * 5/1899 Lang ..... A61B 19/0256 211/85.13
2,963,170 A * 12/1960 Lori ..... A47B 96/024 108/106
3,525,442 A * 8/1970 Novales ..... A47B 57/30 211/193
4,203,373 A * 5/1980 Conti ..... A47B 57/06 108/62
4,262,901 A * 4/1981 Faust ..... A63B 21/078 482/104
4,310,193 A * 1/1982 Kolleas ..... B60N 3/063 280/727
4,650,186 A * 3/1987 McCreery ..... A63B 21/4005 482/104

(Continued)

FOREIGN PATENT DOCUMENTS

GB 2326328 A * 12/1998 ..... A47B 96/06

*Primary Examiner* — Stanton L Krycinski
(74) *Attorney, Agent, or Firm* — Meagher Emanuel Laks Goldberg & Liao, LLP

(57) ABSTRACT

Disclosed is a weight training equipment storage rack system for storing weight training equipment, comprising: a main frame including an upright having a plurality of mounting holes formed therethrough and arranged along a center longitudinal axis of the upright; and a plurality of hanging shelves, each including a fixing rod and an equipment storage unit, the fixing rod having a rod diameter adapted to a hole diameter of the mounting hole and having a rod length not less than a hole depth of the mounting hole, and the equipment storage unit being formed extending outwardly from the fixing rod for storage of the weight training equipment, wherein each hanging shelf is detachably mounted on the main frame by inserting the fixing rod into a selected one of the plurality of mounting holes for storing various weight training equipment in the respective equipment storage units of the hanging shelves.

4 Claims, 5 Drawing Sheets

(56) References Cited

U.S. PATENT DOCUMENTS 4,754,841 A * 7/1988 Koffski ..... E06C 9/04 248/217.1
5,570,957 A * 11/1996 Kuly ..... A63B 23/00 384/42
5,644,993 A * 7/1997 Dohnalik ..... A47B 21/02 248/217.1
5,727,764 A * 3/1998 Angeles ..... A47B 57/482 248/295.11
6,149,556 A * 11/2000 Jordan ..... A63B 71/0036 482/106
6,173,848 B1 * 1/2001 Bravo ..... H05K 7/1425 211/187
6,202,570 B1 * 3/2001 Kurtsman ..... H04Q 1/08 211/187
D444,827 S * 7/2001 Mobley ..... A63B 21/078 D21/694
6,504,100 B2 * 1/2003 Lawrence ..... H02B 1/202 248/65
7,635,322 B2 * 12/2009 Parrilla ..... A63B 23/0405 482/94
7,699,756 B2 * 4/2010 Piane, Jr. ..... A63B 1/00 248/222.52
7,931,160 B2 * 4/2011 Newbouild ..... A47B 96/1408 211/90.02
9,216,314 B2 * 12/2015 Chen ..... A63B 21/16
9,289,638 B2 * 3/2016 Towley, III ..... A63B 21/00047
9,333,387 B2 * 5/2016 Hopperstad ..... A63B 21/00047
9,492,701 B1 * 11/2016 Bognatz ..... A63B 21/072
9,597,539 B2 * 3/2017 Grider ..... A63B 21/00047
9,630,046 B2 * 4/2017 Childs ..... A63B 21/00047
9,907,991 B2 * 3/2018 Leipheimer ..... A63B 21/0626
D818,547 S * 5/2018 Meredith ..... D21/686
10,058,728 B2 * 8/2018 Kelly ..... A63B 21/078
10,084,327 B2 * 9/2018 Roberts ..... H02J 7/0044
10,086,226 B2 * 10/2018 Nelson ..... A63B 21/4035
10,307,634 B2 * 6/2019 Young ..... A63B 71/023
10,391,377 B1 * 8/2019 Sorin ..... A63B 22/0046
10,426,993 B2 * 10/2019 Ostmeyer ..... A63B 21/0783
D890,273 S * 7/2020 Dunahay ..... D8/372
10,792,535 B2 * 10/2020 Chou ..... A63B 1/00
D907,725 S * 1/2021 Adams ..... D21/694
10,926,151 B2 * 2/2021 Dunahay ..... A63B 23/1218
10,953,301 B2 * 3/2021 Brasch ..... A63B 23/03525
D915,533 S * 4/2021 Adams ..... D21/694
10,967,217 B2 * 4/2021 Arroyo ..... A63B 21/0626
10,967,218 B2 * 4/2021 Murrell ..... A63B 17/00
10,974,091 B1 * 4/2021 Hensler ..... A63B 21/062
11,110,316 B2 * 9/2021 Sergakis ..... A63B 21/078
11,260,260 B2 * 3/2022 Hammond ..... A63B 71/0619
11,541,268 B2 * 1/2023 Auerbach ..... A63B 21/078
11,918,843 B2 * 3/2024 Sorin ..... A63B 21/0783
12,161,902 B1 * 12/2024 Whiteley ..... A63B 23/1218
D1,060,549 S * 2/2025 Sorin ..... D21/694
12,285,671 B1 * 4/2025 Chang ..... F16B 7/1454
D1,076,644 S * 5/2025 McGrotty ..... D8/356
D1,076,648 S * 5/2025 McGrotty ..... D8/356
2005/0009671 A1 * 1/2005 Hummer ..... A63B 71/0036 482/94
2009/0072111 A1 * 3/2009 Piane, Jr. ..... A63B 69/222 248/309.1
2015/0016919 A1 * 1/2015 Tambornino ..... F16B 35/06 411/366.1
2017/0246496 A1 * 8/2017 Nelson ..... A63B 21/0724
2018/0064984 A1 * 3/2018 Adrillon ..... A63B 23/1209
2018/0178051 A1 * 6/2018 Shaw, Jr. ..... A63B 21/078
2020/0114191 A1 * 4/2020 Chen ..... A63B 71/0036
2020/0222745 A1 * 7/2020 Leipheimer ..... A63B 23/03525
2021/0187342 A1 * 6/2021 Coulter ..... A63B 21/078

* cited by examiner

WEIGHT TRAINING EQUIPMENT STORAGE RACK SYSTEM

FIELD OF THE INVENTION

The present invention relates to a storage rack, and more particularly relates to a weight training equipment storage rack system.

BACKGROUND OF THE INVENTION

Conventional storage racks for weight training equipment usually can only rigidly provide storage space for a single type of weight training equipment, thereby limiting the flexibility and mobility in terms of use or space utilization.

Therefore, there is still a need to improve the storage racks for weight training equipment in a prior art.

SUMMARY OF THE INVENTION

Accordingly, one objective of the present invention is to provide a weight training equipment storage rack system that allows users to adjust the rack's configuration according to their needs, thereby enhancing storage efficiency.

In order to overcome the technical problems in the prior art, the present invention provides a weight training equipment storage rack system for storing weight training equipment, comprising: a main frame including a self-supporting upright having a plurality of mounting holes formed therethrough and arranged along a center longitudinal axis of the self-supporting upright; and a plurality of hanging shelves, each including a fixing rod and an equipment storage unit, the fixing rod having a rod diameter adapted to a hole diameter of the mounting hole and having a rod length not less than a hole depth of the mounting hole, and the equipment storage unit being formed extending outwardly from the fixing rod for storage of the weight training equipment, wherein each hanging shelf is detachably mounted on the main frame by inserting the fixing rod into a selected one of the plurality of mounting holes for storing various weight training equipment in the respective equipment storage units of the hanging shelves.

In one embodiment of the present invention, the weight training equipment storage rack system is provided, wherein the equipment storage unit is a weight training equipment hanging tray.

In one embodiment of the present invention, the weight training equipment storage rack system is provided, wherein the equipment storage unit is a weight training equipment hanging holder.

In one embodiment of the present invention, the weight training equipment storage rack system is provided, wherein the self-supporting upright is a quadrangular self-supporting upright.

In one embodiment of the present invention, the weight training equipment storage rack system is provided, wherein the mounting holes are formed through the self-supporting upright in a manner perpendicular to the center longitudinal axis of the self-supporting upright.

In one embodiment of the present invention, the weight training equipment storage rack system is provided, wherein the self-supporting upright is a hollow self-supporting upright.

With the technical means adopted by the present invention, the weight training equipment storage rack system allows users to select the types of the hanging shelves mounted on the main frame or to adjust the positions of these hanging shelves on the main frame unit according to their storage needs or spatial planning, thereby enhancing the efficiency of storing and organizing weight training equipment.

DETAILED DESCRIPTION OF THE PREFERRED EMBODIMENTS

The preferred embodiments of the present invention are described in detail with reference to FIG. 1*a* to FIG. 3. The description is used for explaining the embodiments of the present invention only, but not for limiting the scope of the claims.

Figure 1A:
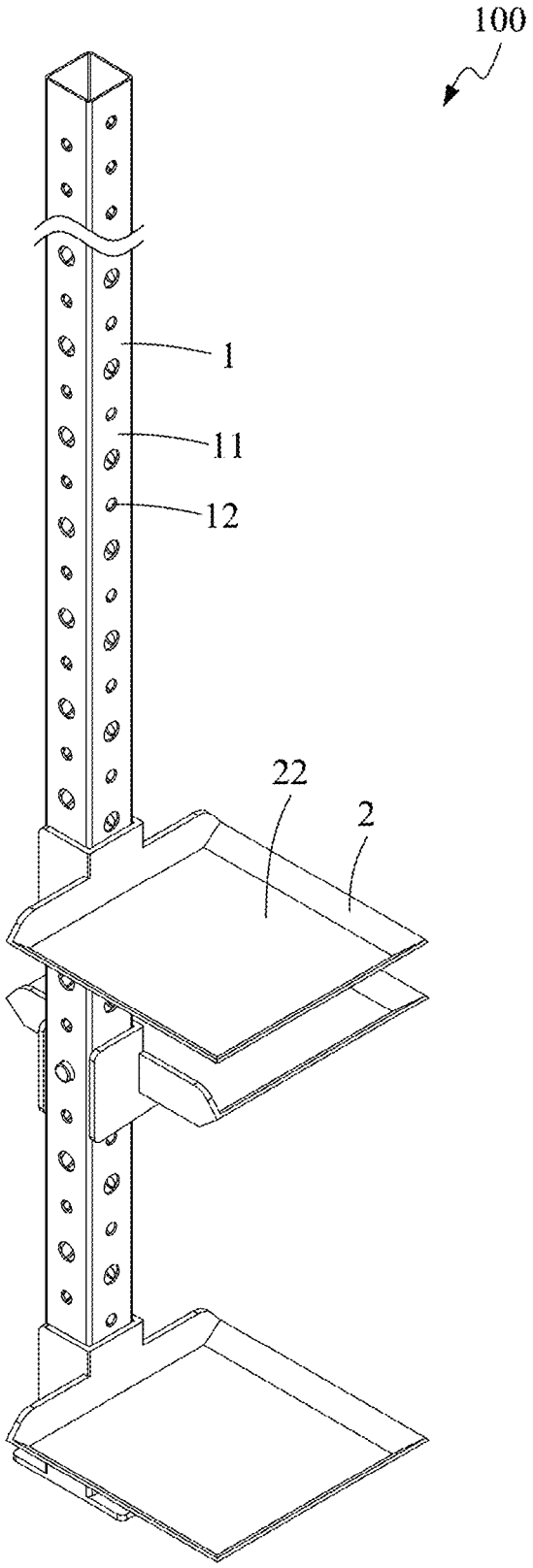
FIG. 1*a* is a schematic perspective view illustrating a weight training equipment storage rack system according to one embodiment of the present invention.

As shown in FIG. 1*a*, a weight training equipment storage rack system 100 according to one embodiment of the present invention for storing weight training equipment comprises: a main frame 1 including a self-supporting upright 11 having a plurality of mounting holes 12 formed therethrough and arranged along a center longitudinal axis of the self-supporting upright 11; and a plurality of hanging shelves 2, each including a fixing rod 21 and an equipment storage unit 22, the fixing rod 21 having a rod diameter adapted to a hole diameter of the mounting hole 12 and having a rod length not less than a hole depth of the mounting hole 12, and the equipment storage unit 22 being formed extending outwardly from the fixing rod 21 for storage of the weight training equipment, wherein each hanging shelf 2 is detachably mounted on the main frame 1 by inserting the fixing rod 21 into a selected one of the plurality of mounting holes 12 for storing various weight training equipment in the respective equipment storage units 22 of the hanging shelves 2.

Figure 1B:
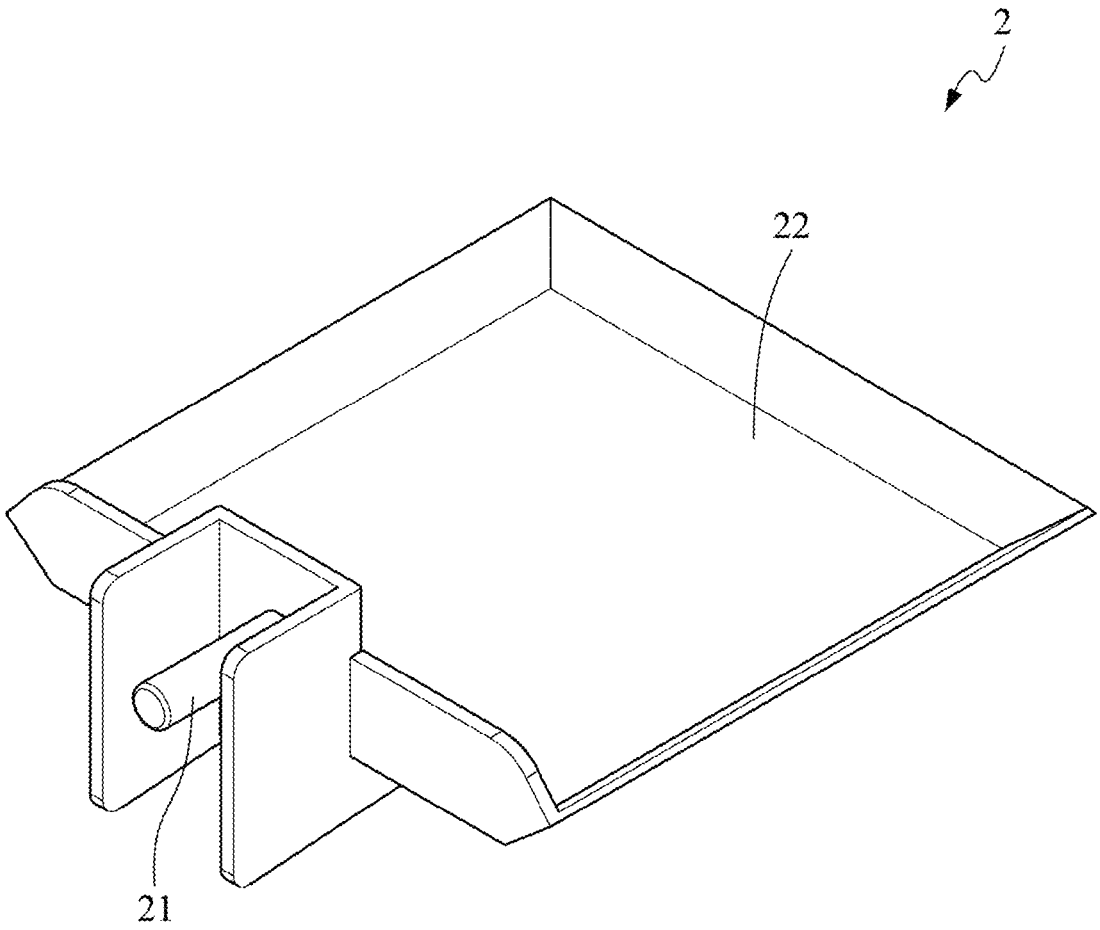
FIG. 1*b* is a schematic perspective view illustrating a hanging shelf of the weight training equipment storage rack system according to the embodiment of the present invention.

As shown in FIG. 1*b*, in the weight training equipment storage rack system 100 according to one embodiment of the present invention, the equipment storage unit 22 is a weight training equipment hanging tray.

Specifically, when the equipment storage unit 22 is a weight training equipment hanging tray, the equipment storage unit 22 is capable of storing the weight training equipment such as kettlebells.

Figure 2A:
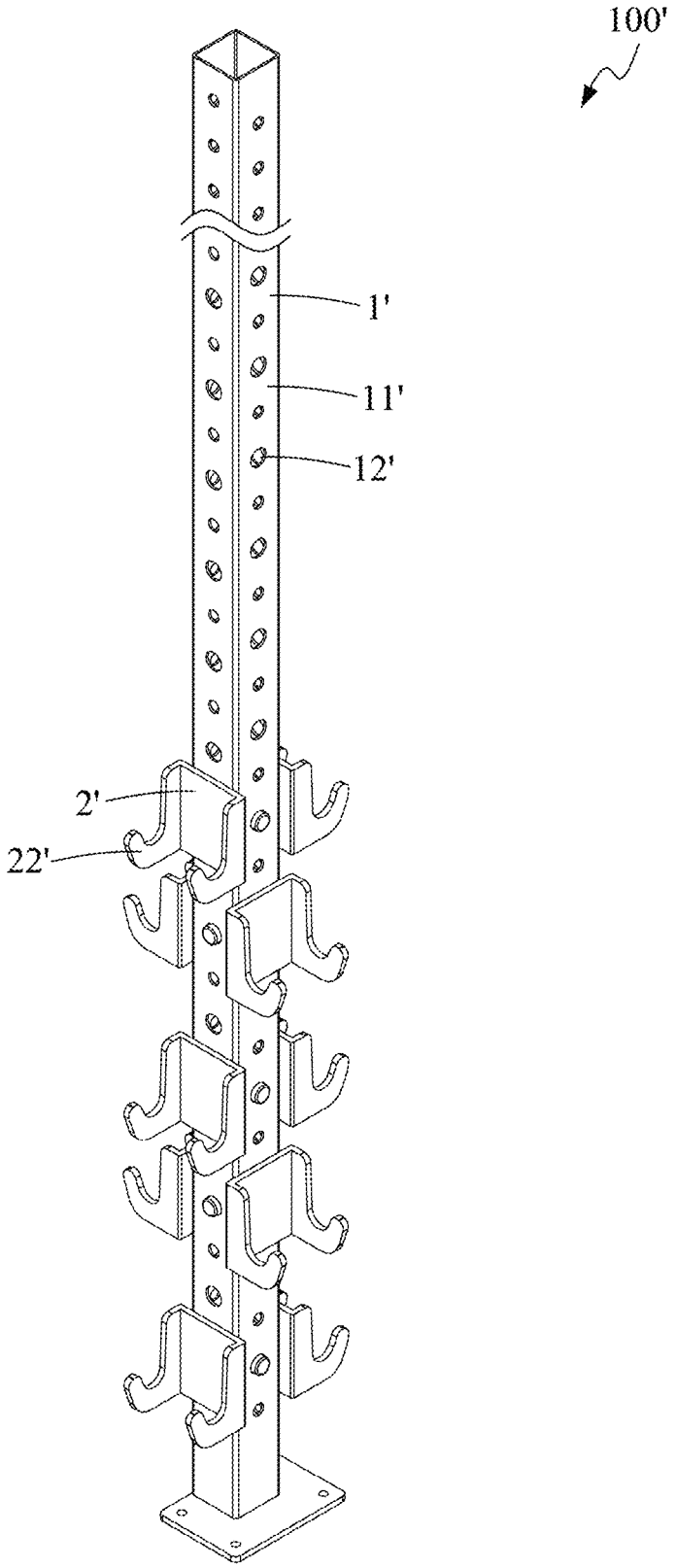
FIG. 2*a* is a schematic perspective view illustrating a weight training equipment storage rack system according to another embodiment of the present invention.

As shown in FIG. 2*a*, a weight training equipment storage rack system 100' according to another embodiment of the present invention for storing weight training equipment comprises: a main frame 1' including a self-supporting upright 11' having a plurality of mounting holes 12' formed therethrough and arranged along a center longitudinal axis of the self-supporting upright 11'; and a plurality of hanging shelves 2, each including a fixing rod 21' and an equipment storage unit 22', the fixing rod 21' having a rod diameter adapted to a hole diameter of the mounting hole 12' and having a rod length not less than a hole depth of the mounting hole 12', and the equipment storage unit 22' being formed extending outwardly from the fixing rod 21' for storage of the weight training equipment, wherein each hanging shelf 2' is detachably mounted on the main frame 1' by inserting the fixing rod 21' into a selected one of the plurality of mounting holes 12' for storing various weight training equipment in the respective equipment storage units 22' of the hanging shelves 2'.

Figure 2B:
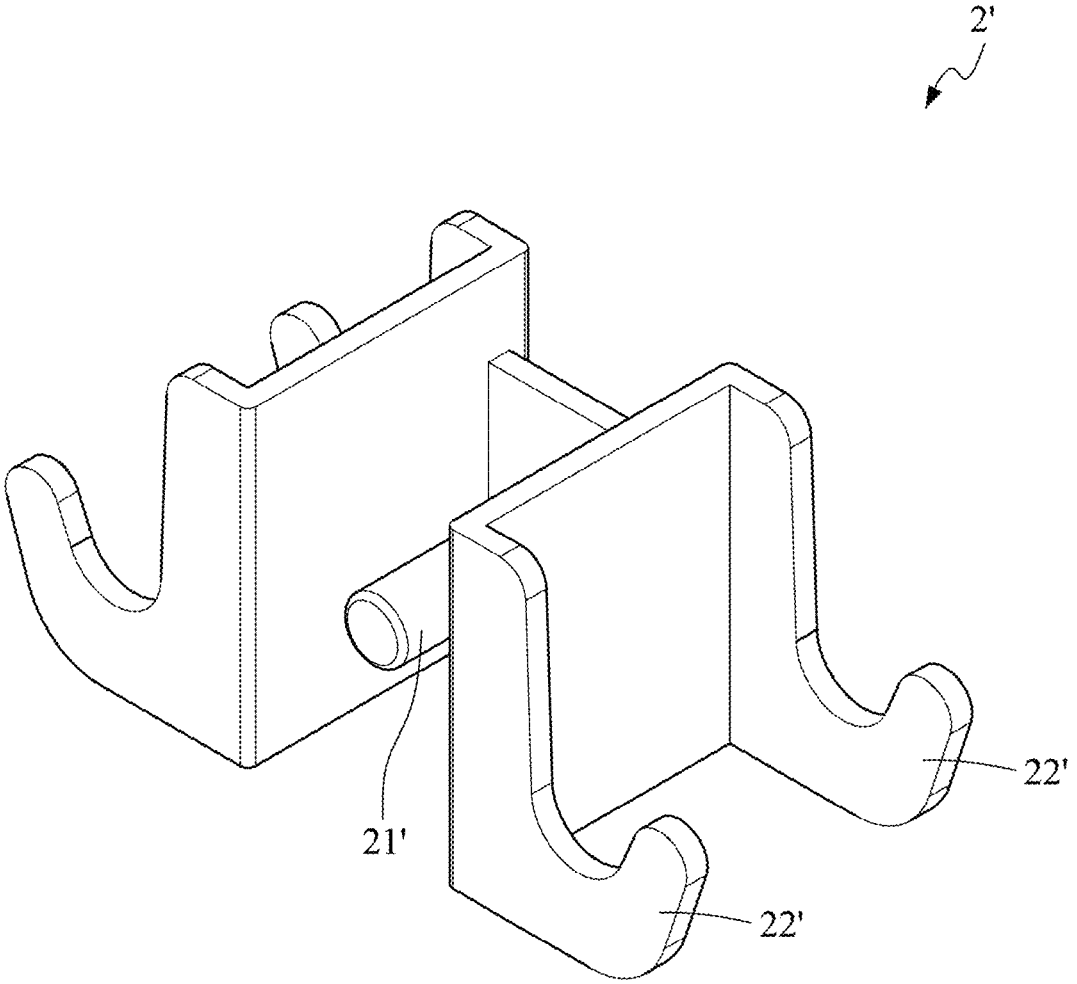
FIG. 2*b* is a schematic perspective view illustrating a hanging shelf of the weight training equipment storage rack system according to the embodiment of the present invention.

As shown in FIG. 2*b*, in the weight training equipment storage rack system 100' according to one embodiment of the present invention, the equipment storage unit 22' is a weight training equipment hanging holder.

Specifically, when the equipment storage unit 22' is a weight training equipment hanging holder, the equipment storage unit 22' is capable of storing the weight training equipment such as dumbbells.

Furthermore, in the weight training equipment storage rack system 100 according to one embodiment of the present invention, the equipment storage unit 22 of the hanging shelves 2 inserted into the mounting holes 12 may not only be the weight training equipment hanging tray (as shown in FIG. 1*b*) but also the weight training equipment hanging holder (as shown in FIG. 2*b*). In other words, users can, according to their needs, insert the hanging shelves 2 with the weight training equipment hanging trays into the selected one of the plurality of mounting holes 12, or insert the hanging shelves 2' with the weight training equipment hanging holders into the selected one of the plurality of mounting holes 12', wherein the hanging shelf 2 with the weight training equipment hanging tray and the hanging shelf 2' with the weight training equipment hanging holder are capable of being mounted on the same main frame 1.

In addition, in the weight training equipment storage rack system 100' according to one embodiment of the present invention, the equipment storage unit 22' of the hanging shelves 2' inserted into the mounting holes 12' may not only be the weight training equipment hanging holder (as shown in FIG. 2*b*) but also the weight training equipment hanging tray (as shown in FIG. 1*b*). In other words, users can, according to their needs, insert the hanging shelves 2' with the weight training equipment hanging holders into the selected one of the plurality of mounting holes 12', or insert the hanging shelves 2 with the weight training equipment hanging trays into the selected one of the plurality of mounting holes 12, wherein the hanging shelf 2' with the weight training equipment hanging holder and the hanging shelf 2 with the weight training equipment hanging tray are capable of being mounted on the same main frame 1.

Figure 3:
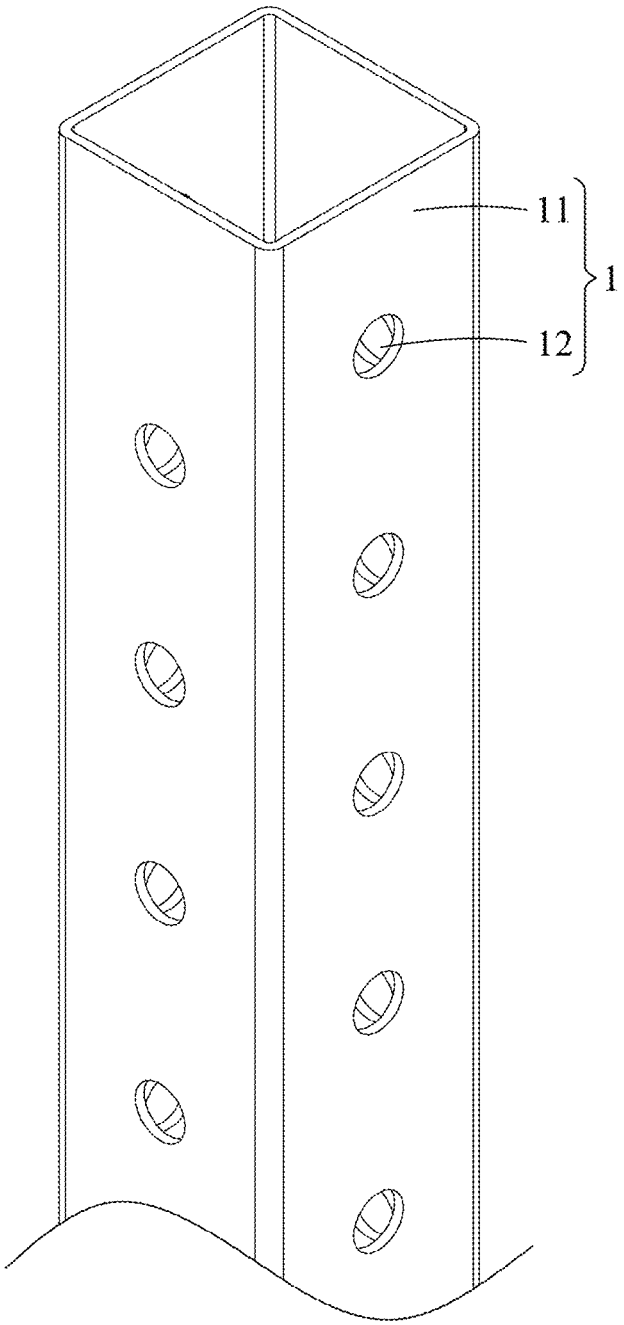
FIG. 3 is a schematic perspective view illustrating a part of the main frame of the weight training equipment storage rack system according to the embodiment of the present invention.

As shown in FIG. 3, in the weight training equipment storage rack system 100 according to one embodiment of the present invention, the self-supporting upright 11 is a quadrangular self-supporting upright.

As shown in FIG. 3, in the weight training equipment storage rack system 100 according to one embodiment of the present invention, the mounting holes 12 are formed through the self-supporting upright 11 in a manner perpendicular to the center longitudinal axis of the self-supporting upright 11.

As shown in FIG. 3, in the weight training equipment storage rack system 100 according to one embodiment of the present invention, the self-supporting upright 11 is a hollow self-supporting upright.

In the weight training equipment storage rack system 100 according to one embodiment of the present invention, the mounting holes 12 located on the two opposite parallel sides of the self-supporting upright 11 are arranged in pairs with the same height from the bottom of the self-supporting upright 11; and as shown in FIG. 3, the mounting holes 12 located on two adjacent sides of the self-supporting upright 11 are arranged at different heights from the bottom of the self-supporting upright 11 in a staggered manner.

With the technical means adopted by the present invention, the weight training equipment storage rack system allows users to select the types of the hanging shelves mounted on the main frame or to adjust the positions of these hanging shelves on the main frame unit according to their storage needs or spatial planning, thereby enhancing the efficiency of storing and organizing weight training equipment.

The above description should be considered as only the discussion of the preferred embodiments of the present invention. However, a person having ordinary skill in the art may make various modifications without deviating from the present invention. Those modifications still fall within the scope of the present invention.

What is claimed is:

1. A weight training equipment storage rack system for storing weight training equipment, comprising:

a main frame including a self-supporting upright having a plurality of mounting holes formed therethrough and arranged along a center longitudinal axis of the self-supporting upright; and a plurality of hanging shelves, each including a fixing rod and an equipment storage unit, the fixing rod having a rod diameter adapted to a hole diameter of the mounting hole and having a rod length not less than a hole depth of the mounting hole, and the equipment storage unit being formed extending outwardly from the fixing rod for storage of the weight training equipment, wherein each hanging shelf is detachably mounted on the main frame by inserting the fixing rod into a selected one of the plurality of mounting holes for storing various weight training equipment in the respective equipment storage units of the hanging shelves, wherein the equipment storage unit is a kettlebell hanging tray or a dumbbell hanging holder, and wherein the weight training equipment storage rack system is configured to enable selective mounting, on the same main frame, of:

(i) the hanging shelves with the kettlebell hanging trays, (ii) the hanging shelves with the dumbbell hanging holders, and (iii) the hanging shelf with the kettlebell hanging tray and the hanging shelf with the dumbbell hanging holder.

2. The weight training equipment storage rack system as claimed in claim 1, wherein the self-supporting upright is a quadrangular self-supporting upright.

3. The weight training equipment storage rack system as claimed in claim 1, wherein the mounting holes are formed through the self-supporting upright in a manner perpendicular to the center longitudinal axis of the self-supporting upright.

4. The weight training equipment storage rack system as claimed in claim 1, wherein the self-supporting upright is a hollow self-supporting upright.

* * * * *